United States Patent [19]

Miller

[11] 3,992,938

[45] Nov. 23, 1976

[54] DEVICE FOR COMPARATIVE TESTING OF THE METALLIC CONTENT OF COINS OR THE LIKE

[76] Inventor: Leo C. Miller, 11110 Dodson Lane, Wheaton, Md. 20902

[22] Filed: Nov. 20, 1975

[21] Appl. No.: 633,906

[52] U.S. Cl. ..... 73/163; 194/100 A

[51] Int. Cl.[2] ..... G07F 3/02

[58] Field of Search ..... 194/100 A, 101; 73/163; 324/71 R, 65 R, 40, 41; 340/262

[56] References Cited

UNITED STATES PATENTS

| | | | |
|---|---|---|---|
| 3,653,481 | 4/1972 | Boxall et al. | 194/100 A |
| 3,797,307 | 3/1974 | Johnston | 194/100 A |

*Primary Examiner*—Allen N. Knowles

[57] ABSTRACT

The invention relates to a device which holds a coin within a moving magnetic field and provides a means for determining the metallic content of the coin based upon the resultant eddy current losses generated in the coin. The moving magnetic field is provided by one or more pairs of magnets mounted in a wheel such that the coin can be inserted into a gap in the wheel through which the magnetic field lines pass. The wheel is accelerated rotationally to a speed higher than some first reference speed, then a precise measurement is made of the time required for the wheel to decelerate from the first reference speed to a second (lower) reference speed. The deceleration is dependent upon the size and shape of the coin, and upon its electrical resistance, which, in turn, is dependent upon the coin's metallic constituents and their proportions, so that the deceleration time for a particular coin can be compared to the deceleration time of like coins, to provide a good measure of the metallurgical authenticity of the coin. The time measurement is facilitated by a stroboscopic pattern affixed to one side of the wheel, so that relative speeds can be accurately identified by observing the wheel while it is illuminated with fluorescent lights. Acceleration of the wheel is provided by a pull-string wrapped around the wheel axle, or by a hand-held motor with a rubber drive wheel. The time required to decelerate between the two reference speeds is measured.

15 Claims, 6 Drawing Figures

DEVICE FOR COMPARATIVE TESTING OF THE METALLIC CONTENT OF COINS OR THE LIKE

BACKGROUND OF THE INVENTION

This invention relates to the field of non-destructive, comparative metal tests, especially those in which it is desired to ascertain whether a given coin has identical metallic content in identical proportions, to coins of the same type which are known to be genuine. While coins of obviously counterfeit nature can be readily detected by physical examination or density tests, clever counterfeiters have produced gold coins of exceptionally authentic appearance and density, but have alloyed the metal with non-precious metals, or used the non-precious metals as internal slugs to cheat on their gold content. The device described herein will readily detect any counterfeit coins in which the metal content and proportions are not those of a genuine coin.

DESCRIPTION OF THE PRIOR ART

The prior art is known to include various techniques and devices intended to perform the above described tests. These include physical examination, acoustical ringing tests, dimension and weight (density) tests, and color comparisons. Devices are also available which place the coin in the alternating magnetic field of an electromagnet and compare the eddy current losses of a test coin with the losses induced by a genuine coin, as read on a meter in the electric drive circuit of the AC magnet. Additionally, coin-operated machines drop or propel inserted coins through a DC field (produced by permanent magnets) and accept or reject the coins depending upon their physical displacement as they pass through the magnetic field.

No devices are known which hold the coin in a fixed position, and measure its eddy current losses by timing the resultant energy loss (deceleration) of an adjacent magnet-bearing rotating structure. Bulk-gold coins are presently assayed in large companies by boring microscopic holes in them — a semi-destructive test — and chemically analyzing the material bored from the hole.

SUMMARY OF THE INVENTION

The proposed coin comparator of the present invention is of relatively simple, inexpensive construction and makes possible the quick, accurate comparison of two or more coins of supposed identical characteristics.

In the illustrated embodiment, the proposed device is configured as a wheel comprised of two discs of non-conducting material mounted on a common axle and held separated by a ring spacer. Imbedded into the inner surface of each disc, in opposing position, are permanent magnet sections, with a steel pole piece connecting the backs of two pairs of magnets, so that a strong magnetic field is generated across the gap between the wheel sections, the flux path passing through the first magnet pair and its associated gap, through the first steel pole piece, through the second magnet pair and its associated gap, returning through the second steel pole piece to close the magnetic path. A like set of magnets and pole pieces is placed on the same wheel diameter across from the first set, to provide balance for the wheel and to produce another pair of flux regions within the gap between the discs.

The common axle for the magnet-bearing wheel is supported at each end in a ball bearing, the ball bearings being seated in the upper portion of upright supports, which are attached to a main support plate.

A coin holder is fashioned to hold coins of any practical size within the gap in the wheel, i.e., between the discs. This holder is removable, to faciliate insertion and removal of the coins, and during test is held firmly in a standard or preset test position by an upright support.

The comparative measurement is made by timing with a stop-watch, for example, the interval between two reference speeds, as shown by a stroboscopic pattern on the wheel, as the wheel decelerates from an initial speed higher than the first reference speed. Light impulses from standard fluorescent lights provide the very accurate timing reference needed to produce precise measurements. The wheel and bearings are so designed that their decelerating effects are stable, and small compared to the effect of the coin's eddy current losses which are induced by the rotating magnetic fields.

From the foregoing discussion it will be seen that a principal objective of this invention is to provide a coin testing device of the type described which will detect counterfeit coins of the type which have different metallic content than genuine coins of the same denomination and type.

Another objective of this invention is to provide a device of the type described which is simple in construction and economical to manufacture.

Another objective of this invention is to provide a device of the type described which is easy and safe to use.

Another objective of this invention is to provide a device of the type described which is compact, durable, and easily transported.

Another objective of this invention is to provide a device of the type described which provides good accuracy and repeatability of measurements without the use of expensive or complicated measuring instruments.

Another objective of this invention is to provide a device of the type described which will test coins of widely differing sizes and metallic compositions, without adjustments to the device.

Another objective of this invention is to provide a device of the type described which will compare metallic samples, other than coins, of various metals and alloys so long as they are dimensionally alike.

Other objects, purposes, and characteristic features of the present invention will in part be pointed out as the description of the invention progresses, and in part be obvious from the accompanying drawings wherein.

Figure 1:
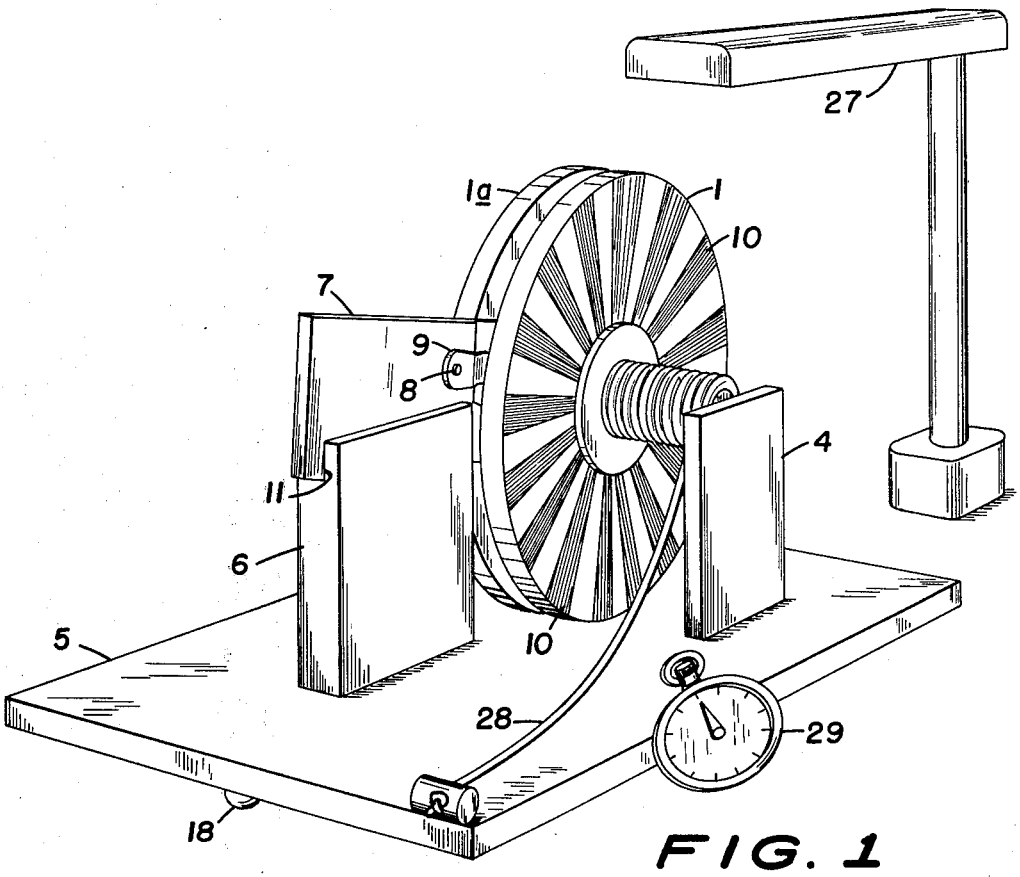
FIG. 1 is a perspective view of the illustrated embodiment showing the unit completely assembled as it would appear when in use.
Figure 2:
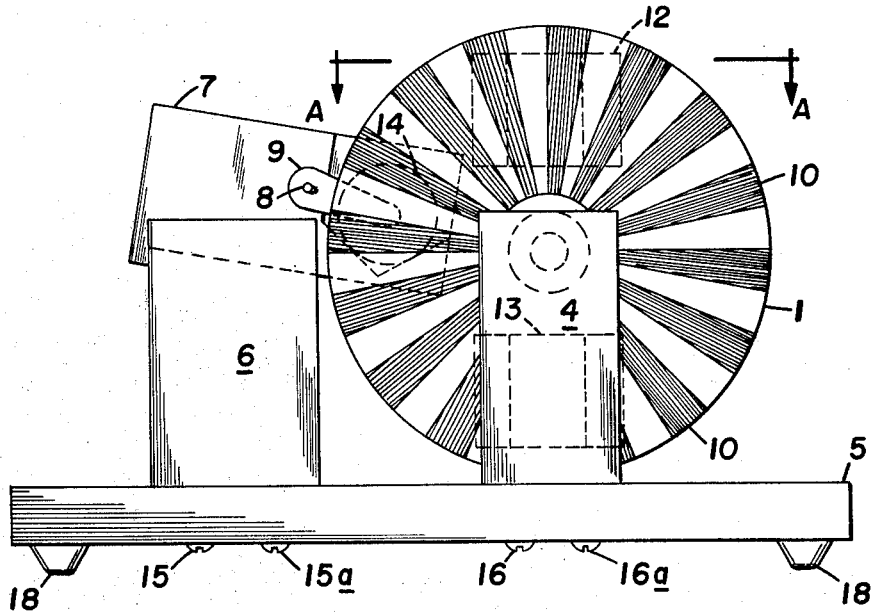
FIG. 2 is a side view of the illustrated embodiment.
Figure 3:
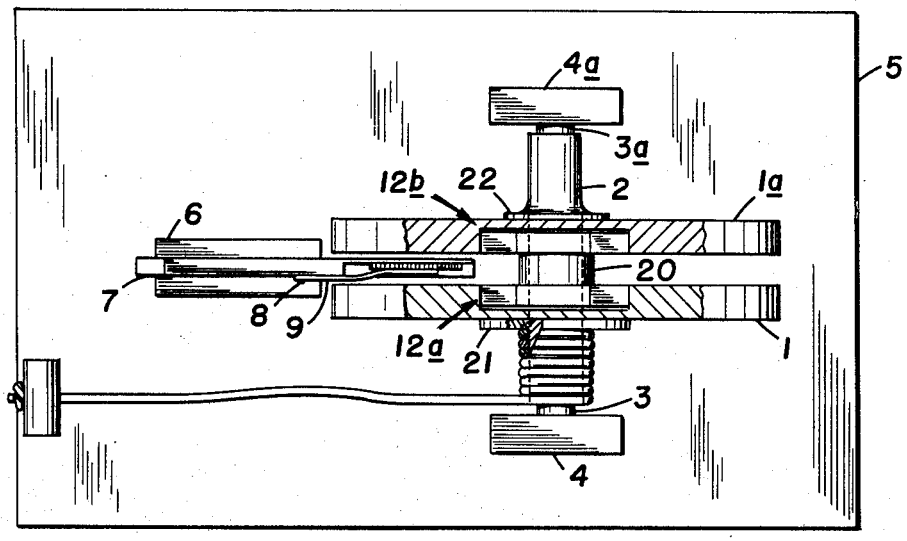
FIG. 3 is a top view, as seen looking in the direction of the arrows along the line AA shown in FIG. 2.

Referring now to FIGS. 1–3, the illustrated embodiment consists of a magnet-bearing split wheel formed by discs 1 and 1*a*, supported by a central axle 2, which is in turn suitably supported at 3 and 3*a*, by ball bearings for example (see FIG. 3), in upright supports 4 and 4*a*. The bearing supports 4 and 4*a* are secured to the base plate 5, to form a rigid support in which the discs 1, 1*a* and axle 2 can spin freely on bearings 3 and 3*a*. An additional upright support 6 is secured to baseplate 5, and is slotted at the top to hold coin-holder 7 in a standard position which places any coin to be tested within the slot between magnet-bearing discs 1, 1*a*. Attached by a swivel-screw 8, a non-metallic spring 9 is so placed that it presses any test coin against the thinned front section of coin-holder 7. Sixteen uniformly spaced radial stroboscopic bars 10 are painted or otherwise distributed on the front side of the split wheel, to enable the precise measurement of two reference speeds as the wheel decelerates during a test. An indexing protrusion 11 on coin-holder 7 assures that the coin-holder stops at the same position each time it is inserted in the slotted top of the coin-holder support 6.

In the side-view FIG. 2, two magnet assemblies 12 and 13 are shown dotted to illustrate their position within the wheel. The front or inner end of the coin holder 7 is also shown dotted over that portion which is in the wheel slot during tests. The position of a typical coin during test is shown at 14. Note that, as the wheel turns, the magnets pass adjacent to the coin, generating a strong magnetic field through the entire volume occupied by the coin. The screws 15 and 15*a* pass through the baseplate 5 into threaded holes in the lower portion of coin-holder support 6 to hold it firmly in position on baseplate 5. Screws 16 and 16*a* in like fashion secure the near bearing support 4 to the baseplate 5 and a similar pair of screws (not shown) would hold the far bearing support 4*a* to the baseplate 5. Rubber feet 18 provide a stable 3-or-4 point non-marring support for the entire assembly when placed on a table top or other horizontal surface during normal use.

FIG. 3 shows a top view as it would appear when viewed in the direction of the arrows along the section line A—A in FIG. 2. This shows the relative positions of the two magnet pairs 12*a* and 12*b* which comprises a typical assembly 12 embedded in the wheel sections or discs 1 and 1*a*. Also visible in this view is the separator ring 20 which holds the wheel sections 1 and 1*a* at a fixed separation distance. A threaded washer 21 engages threads provided on axle 2 to hold the wheel sections 1 and 1*a* firmly together and pressed against the shoulder 22 provided on axle 2.

Figure 4:
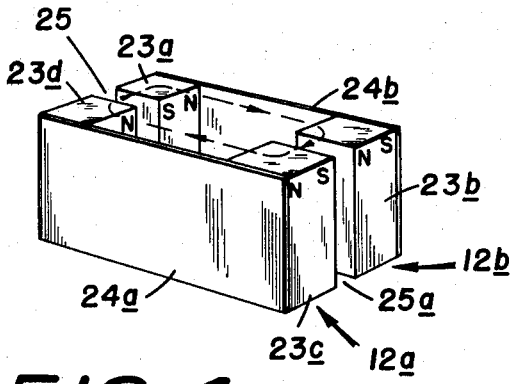
FIG. 4 is a perspective view of one of the internal magnetic assemblies shown dotted in FIG. 2.

FIG. 4 is a perspective view of one of the two identical magnetic assemblies 12 and 13, to better illustrate the magnetic arrangement. Using magnetic assembly 12 as the illustrated example, it may be seen that it consists of four identical bar magnets 23*a*, 23*b*, 23*c*, 23*d* connected in pairs 12*a* and 12*b* by steel polepieces 24*a* and 24*b*. The north (N) and south (S) poles of the magnets are shown. Note that each magnet augments the flux around the magnetic circuit, generating flux paths as shown at the gaps 25 and 25*a*. Since the two separated components of the assembly are affixed in cavities in the wheel sections 1 and 1*a*, the gaps 25 and 25*a* are established and held fixed by the wheel spacing ring 20 (see FIG. 3).

Figure 5:
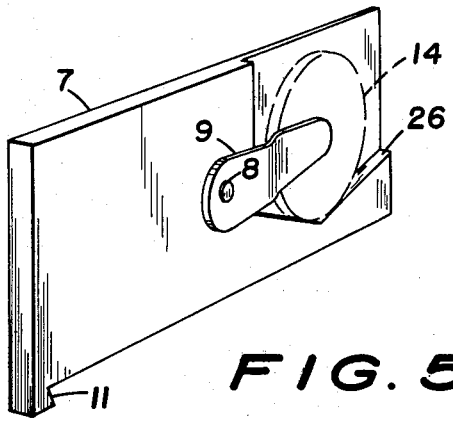
FIG. 5 is a perspective view of the coin holder assembly shown in FIGS. 1, 2, and 3.

FIG. 5 shows the coin holder 7 in perspective with the attached coin-stabilizing spring 9 and its swiveled holding screw 8. A typical coin to be tested is shown in the holder as 14. Note that the coin-retaining end of the holder 7 is thinner than the main body of the holder, so that this portion of the holder, with the coin in it resting on V-shaped shoulder 26 will slide into the slot between the discs 1 and 1*a*. (See also Fig. 3). The protrusion 11 which stops the forward motion of the coin holder when being inserted into the wheel gap functions to index the coin holder in its test position. The non-metallic spring 9 will swivel about its holding screw 8 so that it will bear approximately on the center of any coin, as coins of different diameters are tested.

To use the device described herein, the device is illuminated by a standard fluorescent light, as shown at 27 in FIG. 1, or other source of precise light flash; e.g., a commercial strobe light, a neon lamp or other gas discharge lamp. With no coin in the holder, a cord, as represented at 28 in FIG. 1, is wrapped around the axle 2 in such a manner that, when pulled, it will rotate the wheel in a CCW direction as viewed in FIG. 2. As the wheel decelerates due to windage and bearing losses, the stroboscopic bars will reach a condition where they appear to stop, when the wheel's rotation speed reaches a value which is subsynchronous to the rate of light flashes from the fluorescent lamp. Exactly at this time, a stop-watch (as shown at 29 in FIG. 1) is started, and observation is continued until the stroboscopic bars again appear to stop, at which time the stop-watch is stopped, and the time noted. This interval is a reference, or calibration interval, and can be used to check the reliability of the device, and its repeatability at any future time.

Next, the coin-holder 7 is removed, and a coin of known genuine character is placed in it at the bottom of the thinned portion of the coin-holder 7, and spring 9 is swiveled to hold the coin pressed against the thin section of the coin holder. Coin-holder (with coin) is now placed in the slot in support 6, and pushed forward until protrusion 11 arrests its forward motion. The coin is now in position to be tested, where the magnetic gaps will pass it when the wheel rotates. Now the wheel is accelerated as before described, and the time interval between the two stroboscopically identified reference speeds is again measured in the same manner as was done previously. A markedly reduced time interval will be noted, the exact time being dependent upon the particular coin under test. If other coins of known genuine character are available, they may be similarly tested, to improve confidence in the measurement previously made, and to further establish a standard time for the particular type of coin being tested. Any coin purported to be of the same type, and not having obvious disparities in size and appearance, must provide the same time interval, when tested as described, or its metallurgical content is necessarily different than those of the genuine reference coin(s). As genuine coins of different types are tested, and time interval data is compiled in chart or graphical format, a ready reference becomes available, against which test coins can be compared to determine their authenticity.

It should be noted that all the parts of the device which are in the vicinity of the magnetic assemblies (except the magnets themselves, and their pole-pieces) are made of nonconducting material, such as plastic, pressed wood, masonite, or the like. This is desirable to minimize eddy-current losses in parts of the device itself, as the wheel spins, since the main effect to be measured is the loss caused by the coin under test. The support-retaining screws 15, 15*a*, 16, 16*a*, and the ball bearings 3 and 3*a* are far enough removed from the magnetics to be inconsequential. The swivel-screw 8 is preferably plastic, or other non-conducting material.

Preferably also, for the sake of accuracy, the device should not be used while standing on a metallic desk or table top, but only on glass, wood, or other non-conducting horizontal surfaces.

In one practical configuration of the device described herein, the wheel segments or discs 1 and 1*a* are 6 inches in diameter, and the gap between the discs is 0.375 inches. The magnets are ceramic and measure 0.9 × 1.9 × 0.4 inches. The pole pieces are cold rolled steel, and measure 2.9 × 1.9 × .09 inches. The axle diameter (where cord is wrapped) is 0.625 inches. The first reference speed (showing all 16 stroboscopic bars) is 900 RPM, and the second reference speed (also showing all 16 bars) is 450 RPM. The coast-down period between 900 RPM and 450 RPM is 248.2 seconds, repeating within ± 0.4 seconds. The losses due to a typical gold coin (US $20) reduce this interval to 33.2 sec ± 0.2 sec.

Figure 6:
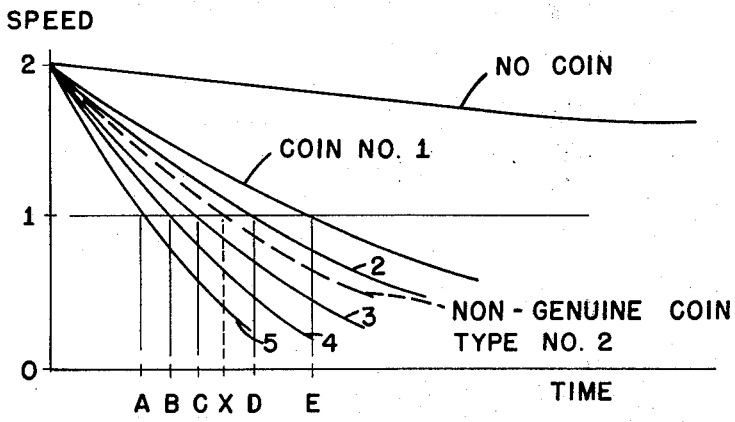
FIG. 6 is a graph showing the speed vs. time characteristics of the device, for typical genuine coins, and for one non-genuine coin.

By way of further example, FIG. 6 illustrates the manner in which wheel rotational speed might vary between the first and second reference speeds, with and without a coin under test and depending upon the exact metal composition of authentic coins (nos. 1 through 5) of different type and denomination, with the curve for a typical non-genuine coin of type no. 2 shown dotted.

Various modifications, adaptations, and alterations to the illustrated embodiment are of course possible. For example, bar magnets without pole pieces could be used, or a different number of magnetic assemblies could be spaced about the wheel. Also, a motor or spring-wound mechanism could be used to accelerate the wheel, and different reference speeds and/or different stroboscopic patterns could be utilized. Additionally, different magnetic field strengths, and different gap dimensions could be used effectively.

It should therefore be understood that within the scope of the appended claims, the invention may be practiced otherwise than as specifically described hereinabove.

What I claim is:

1. Apparatus for testing the metallic content of a coin or the like comprising:

magnetic means for generating a magnetic field in an air gap, means connected to move said magnetic means for moving said magnetic field relative to said coin or the like along a predetermined path, means for holding said coin or the like stationary with respect to said predetermined path to cause said coin or the like to traverse said air gap, and means for measuring the deceleration effect on said magnetic means during movement of said magnetic field relative to said coin or the like.

2. The apparatus specified in claim 1 wherein said magnetic means comprises a wheel carrying a permanent magnet means adjacent said coin or the like, wherein said movement means comprises means for rotating said wheel, and wherein said measurement means measures changes in the rotational speed of said wheel.

3. The apparatus specified in claim 2 wherein said wheel is formed of a pair of disc members mounted on a common axis and spaced from one another by an air gap, wherein said magnetic field is generated within the air gap between said disc members, and wherein said coin or the like is held stationary within said air gap during rotation of said wheel about said axis.

4. The apparatus specified in claim 3 wherein said magnetic means comprises a pair of permanent magnets mounted across from one another in said pair of disc members.

5. The apparatus specified in claim 4 further including a second pair of permanent magnets mounted across from one another in said pair of disc members in diametrically opposed relationship to and in balanced alignment with the other pair of permanent magnets.

6. The apparatus specified in claim 1 wherein said coin holding means includes means for indexing said coin to a predetermined test position within said air gap.

7. The apparatus specified in claim 1 wherein said magnetic means comprises a movable member and a permanent magnet mounted on said movable member, wherein said holding means comprises a support member for releasably holding said coin or the like, and wherein both said movable magnet mounting member and said coin holding member are formed of non-conducting material.

8. The apparatus specified in claim 2 wherein said measurement means comprises means for timing the interval between first and second predetermined reference rotational speeds of said wheel during deceleration.

9. The apparatus specified in claim 8 wherein said measurement means includes:

a stroboscopic pattern on an exterior surface of said wheel, a source of flashing light illuminating said exterior surface to stop rotation of said pattern at said first and second reference speeds during rotation of said wheel, and means monitoring said pattern for timing the interval between said first and second reference speeds.

10. The apparatus specified in claim 9 wherein said flashing light source is a fluorescent lamp.

11. The apparatus specified in claim 3 wherein said holder means includes an arm member extending into the air gap between said discs and a spring retainer means for holding said coin or the like releasably onto said arm member.

12. The apparatus specified in claim 11 wherein said holder means further includes a vertical support member and said arm member is mounted on said support member extending substantially horizontal:

said vertical support member being formed with a slot to slidably receive said horizontal arm member, said horizontal arm member being formed with an indexing protrusion which abuts said vertical support member when said coin or the like is in proper test position and a shoulder which supports said coin or the like and against which said spring retainer means holds said coin or the like.

13. The apparatus specified in claim 12 further including a pair of vertical bearing arms for supporting the opposite ends of said common axle, and a base member for securing in position said vertical support member and said pair of vertical bearing arms.

14. A method for testing the metallic composition of a coin or similar sample comprising the steps of:

positioning said coin or sample in fixed reference test position, moving a magnetic field source adjacent said positioned coin or sample to subject said coin or sample to the magnetic field generated by said source, and measuring the deceleration effect on said moving magnetic field source caused by the presence of said coin or sample in said moving magnetic field.

15. The method specified in claim 14 wherein the step of moving said magnetic field source involves rotating a wheel carrying a permanent magnet, and wherein the step of measuring the deceleration effect on said moving magnetic field source involves measuring the time interval between first and second reference speeds of rotation of said wheel.

* * * * *